US006616322B1

(12) United States Patent
Ashcroft et al.

(10) Patent No.: US 6,616,322 B1
(45) Date of Patent: Sep. 9, 2003

(54) MIXING APPARATUS

(75) Inventors: Peter Leonard Ashcroft, Tynemouth (GB); David William Arnold, Gateshead (GB)

(73) Assignee: Eric George Evans, Bridgnorth Shropshire (GB)

( * ) Notice: Subject to any disclaimer, the term of this patent is extended or adjusted under 35 U.S.C. 154(b) by 0 days.

(21) Appl. No.: 10/070,373

(22) PCT Filed: Sep. 7, 2000

(86) PCT No.: PCT/GB00/03439

§ 371 (c)(1),
(2), (4) Date: Mar. 6, 2002

(87) PCT Pub. No.: WO01/17668

PCT Pub. Date: Mar. 15, 2001

(30) Foreign Application Priority Data

Sep. 7, 1999 (GB) ..... 9921065

(51) Int. Cl.[7] ..... B01F 5/04; B01F 5/20

(52) U.S. Cl. ..... 366/167.2; 366/174.1

(58) Field of Search ..... 366/167.2, 167.1, 366/168.2, 169.1, 170.4, 172.1, 173.2, 177.1, 286, 289, 314, 174.1, 175.2

(56) References Cited

U.S. PATENT DOCUMENTS

| | | | | | |
|---|---|---|---|---|---|
| 2,588,591 | A | * | 3/1952 | Thompson | 366/167.2 |
| 3,312,400 | A | * | 4/1967 | Clearman | 239/206 |
| 4,394,966 | A | * | 7/1983 | Snyder et al. | 366/174.1 |
| 4,878,758 | A | * | 11/1989 | Schafer et al. | 366/101 |
| 5,183,335 | A | * | 2/1993 | Lang et al. | 366/175.2 |
| 5,564,825 | A | * | 10/1996 | Burt | 366/175.2 |
| 5,681,109 | A | * | 10/1997 | Palmer | 366/167.1 |

FOREIGN PATENT DOCUMENTS

GB 2 333 047 * 7/1998

* cited by examiner

*Primary Examiner*—Tony G. Soohoo
(74) *Attorney, Agent, or Firm*—Larson & Taylor PLC

(57) ABSTRACT

Apparatus for mixing liquid in a container, comprises a hollow sleeve member for location in the lower regions of the container, a plurality of circumferentially spaced outlets being provided in the upper regions of the sleeve member, pump means for creating a reciprocating flow of liquid applied to the lower regions of the sleeve member, and in the flow path of liquid from the pump means to the sleeve member, a transducer mechanism cooperating with the sleeve member and subjected to the reciprocating flow of liquid such as to rotate the sleeve member about its central longitudinal axis in dependence upon said reciprocating flow.

7 Claims, 5 Drawing Sheets

MIXING APPARATUS

TECHNICAL FIELD

This invention relates to mixing apparatus, and has particular though not exclusive application to such apparatus for mixing liquids in relatively large containers, for example paints in intermediate bulk containers (IBC).

BACKGROUND

It is often necessary, prior to application or use, to mix the contents of large containers, in particular paint containers, to condition the paint for smooth and effective application.

Heretofore, such mixing has been achieved in a variety of ways all of which suffer from various disadvantages.

Impellers such as propellers comprising a plurality of spiral blades on a rotating shaft are commonly used. However, removal of the propeller after mixing invariably results in paint dripping from the propeller onto the outside of the container. Furthermore, the use of a propeller in anything other than a full container can result in considerable splashing of paint within and without the container, as well as undesirable entrainment of air into the paint by way of the central vortex created by the rotating propeller.

Impellers are conventionally inserted through the top of a container to effect mixing, and, as mentioned above, can create problems if the container is only partially full.

It has been proposed to achieve mixing by means of a unit attached to the bottom of a container and reacting with the contents of the lower regions of the container to create mass movement throughout the volume of the container which is effective even if the container is other than full.

More particularly the unit includes a disc extending transversely of the lower regions of the container and provided with a central aperture surrounded by a plurality a circumferentially spaced apertures adjacent the periphery of the disc.

A diaphragm below the disc is alternately moved upwards and downwards relative to the disc, the configuration of the apertures in the disc being such that, on upward movement of the diaphragm liquid is preferentially forced upwardly through the central aperture, and, on downward movement of the diaphragm, liquid is preferentially drawn downwardly through the peripheral apertures. Thus a swirling motion is created within the container which serves to mix the contents thereof.

Such equipment, although non-intrusive, is complex and expensive, the mixing effect being very dependent upon the frequency of movement of the diaphragm, and is only suited to cylindrical containers.

An alternative to the above equipment utilises a static funnel from which radiate a plurality of circumferentially spaced jet outlets, an air-operated double diaphragm pump creating mass movement of the liquid towards and away from the funnel. On movement of the liquid towards the funnel, the liquid is preferentially forced through the outlets to create jets of liquid within the lower regions of the container, and, on movement of the liquid away from the funnel, liquid is drawn down through the centre of the funnel, the overall system being such as to create a swirling motion within the body of liquid.

Such a static jet mixer has been found to create closed cells within the body of liquid which remain unmixed and in which there is considerable heat build-up. Overall, mixing is unsatisfactory.

SUMMARY OF THE INVENTION

It would be desirable to be able to provide mixing apparatus which overcame the problems of the prior art, and in particular which ensured effective mixing of the full volume of contained liquid in an economic and cost effective manner.

According to the present invention there is provided, for a liquid container, mixing apparatus comprising a hollow sleeve member for location in the lower regions of the container, a plurality of circumferentially spaced outlets being provided in the upper regions of the sleeve member, and pump means for creating a reciprocating flow of liquid applied to the lower regions of the sleeve member, characterised by, in the flow path of liquid from the pump means to the sleeve member, a transducer mechanism co-operating with the sleeve member and subjected to the reciprocating flow of liquid such as to rotate the sleeve member about its central longitudinal axis in dependence upon said reciprocating flow.

It will be appreciated that, with such an arrangement, and as a result of the rotation of the sleeve member, which is typically through 15° for each pulse of liquid, the jets of liquid emanating from the outlets are each directed in continuously changing directions within the container, thereby ensuring thorough mixing of the liquid and avoiding the establishment of any substantially static regions of non-agitation within the liquid.

In one embodiment of the invention, the pump means comprise a double acting diaphragm pump, the reciprocating movement of the diaphragm creating a mass movement of liquid into and out of the container.

Preferably the transducer mechanism comprises a ratchet wheel secured to, to be rotatable with, the sleeve member, and one or more pawls adapted to engage the ratchet wheel and linearly movable by, in the direction of movement of, the reciprocating liquid.

Conveniently there are two pawls mounted on a carrier and engaging diametrically opposite teeth of the ratchet wheel, the reciprocating movement of the liquid resulting in reciprocating movement of the carrier and attached pawls, each such movement of the carrier resulting in consequential stepped rotation of the sleeve member, each step being in the same direction of rotation.

Preferably there are two diametrically opposed outlets from the upper regions of the sleeve member, each outlet being directed substantially radially from the sleeve member.

The sleeve member and associated transducer mechanism may be located wholly within the lower regions of the associated container to provide a non-intrusive mixing system.

Alternatively, the sleeve member may extend through an aperture in the container to locate the outlets therefrom within the lower regions of the container, the lower regions of the sleeve member and the transducer mechanism being external of the container to provide an intrusive mixing system.

DETAILED DESCRIPTION OF THE PREFERRED EMBODIMENTS

Figure 1:
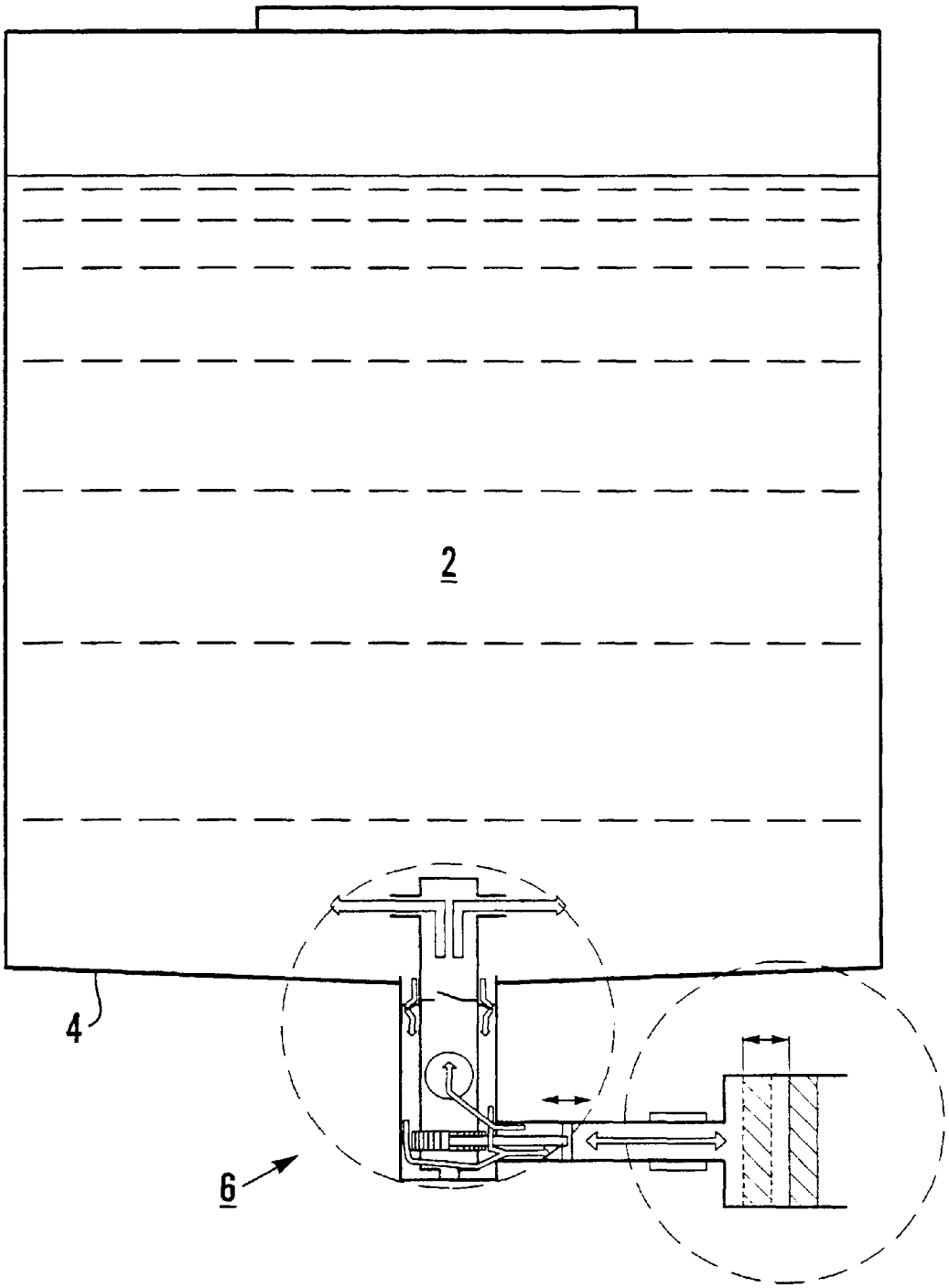
FIG. 1 is a diagrammatic vertical section through mixing apparatus according to the invention in a container.
Figure 2A:
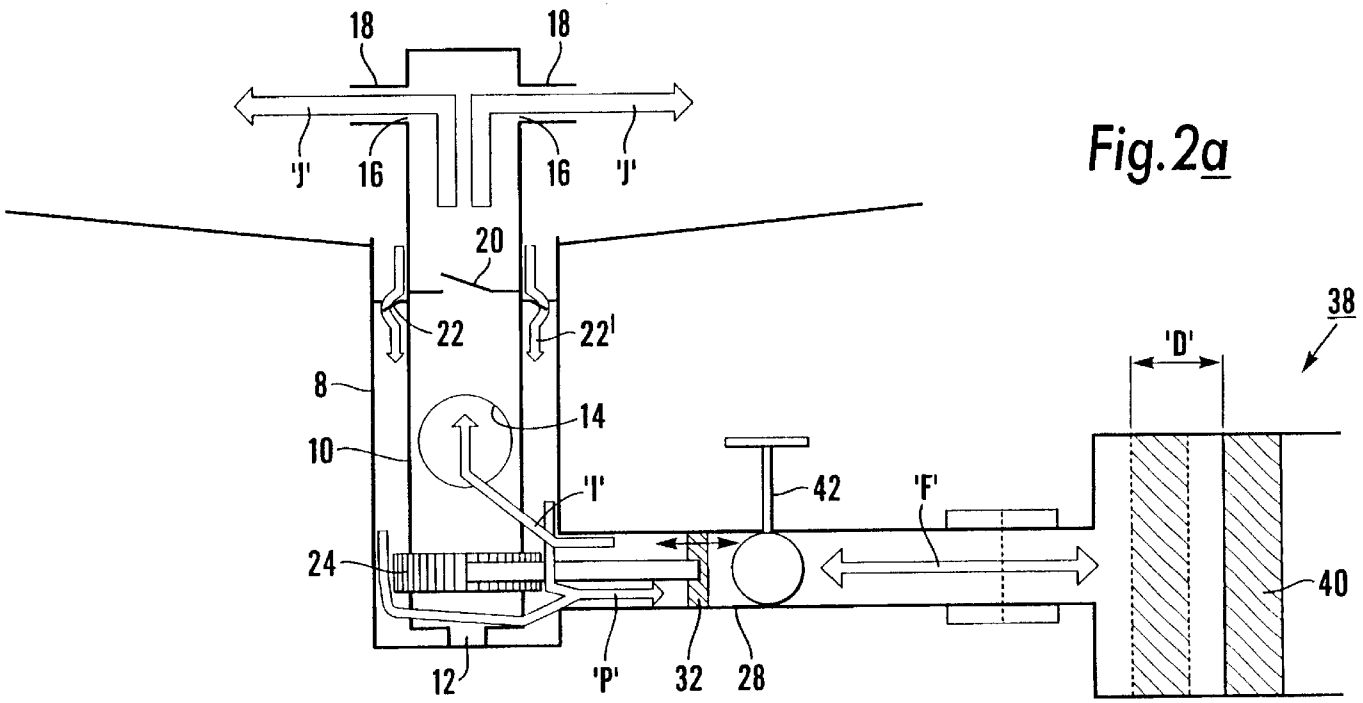
FIG. 2*a* shows the apparatus of FIG. 1 to a larger scale.
Figure 2C:
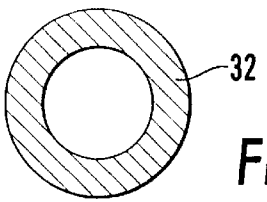
FIG. 2*c* is an end view of the carrier of FIGS. 2*a* and 2*b;*

Referring to FIGS. 1 and 2, there is shown a container 2, typically an intermediate bulk container for holding paint, in the bottom wall 4 of which is mounted mixing apparatus according to the invention and generally referenced 6.

The mixing apparatus 6 comprises an outer cylindrical housing 8 secured through the bottom wall 4 of the container in sealed relationship therewith, and a hollow sleeve 10 coaxially within the housing 8 and rotatable relative thereto about its central longitudinal axis on a bearing 12.

An inlet 14 in the lower regions of the sleeve 10 feeds into the hollow interior thereof from the annular volume between the housing 8 and the sleeve 10, while a pair of diametrically opposed outlets 16 are formed in the sidewalls of the sleeve 10 adjacent the upper regions thereof, the outlets 16 being defined by substantially radially extending nozzles 18.

A circular one-way valve mechanism or flow restrictor 20 is mounted within the sleeve 10 above the inlet 14 such as to permit upward flow through the sleeve but to prevent downward flow therethrough.

An annular one-way valve or flow restrictor 22 is mounted in the annular volume between the housing 8 and the sleeve 10 adjacent the upper regions of the housing 8 to permit downward flow as indicated by arrows 22' through this annular volume but to prevent upward flow therethrough.

An annular ratchet wheel 24 is secured around the lower regions of, to be rotatable with, the sleeve 10, the ratchet wheel carrying a plurality of external teeth 26.

A discharge pipe 28 feeds from the lower regions of the housing 8, a pawl mechanism indicated generally at 30 being slidably mounted in the pipe 28.

Figure 2B:
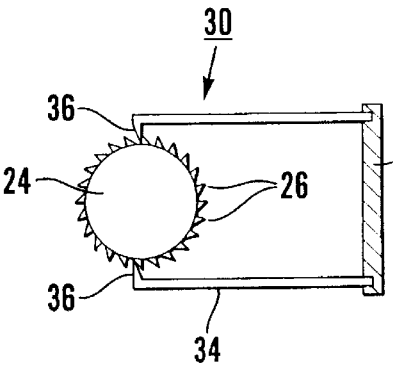
FIG. 2*b* is a plan view of the ratchet wheel, pawls and carrier of FIG. 2*a;*

The mechanism 30 comprises an annular disc 32 extending transversely of the pipe 28 to be guided thereby, a yoke 34 extending from the disc 32 longitudinally of the pipe 28 the opposed arms of which each carry at the free ends thereof a pawl 36. The pawls 36 co-operate with the teeth 26 of the ratchet wheel 24 as best seen in FIG. 2*b* and such that, on either forward or rearward movement of the mechanism 30 relative to the sleeve 10, the ratchet wheel 24, and therefore the sleeve 10, is rotated in a clockwise direction as viewed in FIG. 2*b*.

Connected to the end of the discharge pipe 28 is one chamber of a double acting diaphragm pump schematically illustrated at 38 the piston assembly 40 of which is reciprocal between the two extreme positions shown in full lines and dotted lines in FIG. 2*a*, the overall displacement of the assembly being indicated by the arrow 'D'.

An isolating valve 42 is provided in the discharge pipe 28 between the mechanism 30 and the pump 38 which is selectively operable to connect the pump 28 into the discharge pipe 28.

The described apparatus operates as follows. With the container 2 holding liquid to be mixed, and with the isolating valve 42 open, the pump 38 is actuated to reciprocate the piston assembly 40. This creates a reciprocating flow in the discharge pipe 28 as indicated by arrow 'F', the effects of which are applied to the mechanism 30 and to the lower regions of the container 2.

More particularly, and as the pump 38 pulses liquid towards the container 2, said liquid flows through the centre of the disc 32, through the inlet 14 as indicated by arrow 'I', through the one-way valve 20 and out of the sleeve 10 through the outlets 16/nozzles 18 as pressurised jets of liquid as indicated by arrows 'J'. The one-way valve 22 prevents upward flow of liquid from the annular space between the housing 8 and the sleeve 10 into the container 2.

At the same time, the flow created by the pump 38 impinges upon the disc 32 to move the mechanism 30 to the left as viewed in FIGS. 2*a* and 2*b*, whereby one of the pawls 36 engages an associated tooth 26 on the wheel 24 to rotate the wheel and attached sleeve 10 in a clockwise direction as viewed in FIG. 2*b*, while the other pawl 36 rides over an opposite associated tooth 26.

On return movement of the piston 40, a reverse flow is created in the discharge pipe 28 and is transmitted to the mechanism 30 and the liquid in the container 2.

More particularly, liquid then flows from the container 2 into the annular space between the housing 8 and the sleeve 10 and through the one-way valve 22 as indicated by arrows 22', and then into the discharge pipe 28 as indicated by arrow 'P'. Flow from the hollow sleeve 10 into the discharge pipe 28 is prevented by the one-way valve 20.

This reverse flow moves the disc 32, and therefore the mechanism 30, to the right as viewed in FIG. 2*a* whereby the other pawl 36 engages an associated tooth 26 of the wheel 24 to further rotate the wheel 24 and attached sleeve 10 in a clockwise direction as viewed in FIG. 2*b*, the one pawl 36 riding over an opposite associated tooth 26.

Thus it will be appreciated that the pump 38 creates a constantly pulsating flow of liquid in the discharge pipe 28, the energy of this flow being used to rotate the sleeve 10 by way of the mechanism 30 and at the same time to create pulses or jets of liquid emanating from the nozzles 18.

Figure 5:
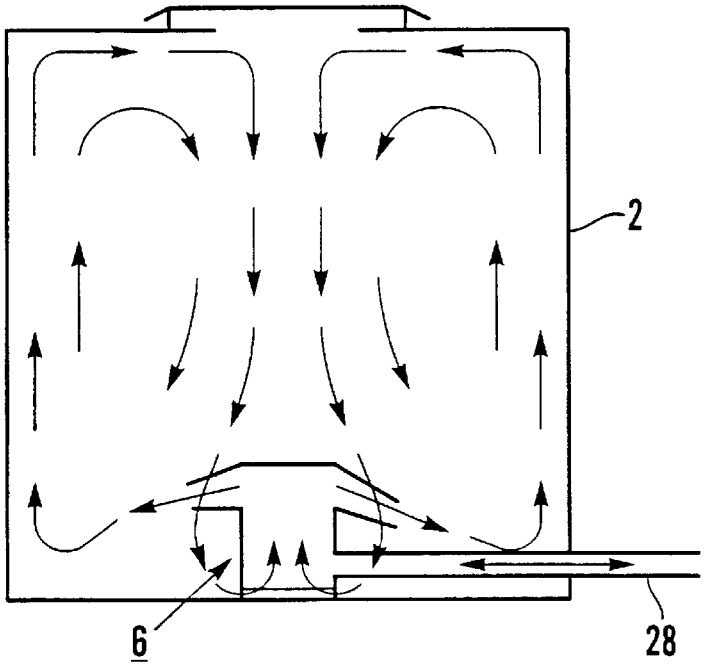
FIGS. 5 and 6 show, schematically and respectively, a non-intrusive and an intrusive mixing apparatus according to the invention.

The jets are directed into the body of liquid as seen in FIG. 5 and serve to create a mixing flow as indicated by the arrows in that Figure.

The pump 38 is typically operated at a frequency of 60 pulses per minute, with the sleeve 10 being rotated through typically 15° for each pulse of the pump.

The constantly rotating sleeve 10, and the consequential constantly changing positions of the nozzles 18 within the container 2 ensure extremely thorough mixing of the contents of the container 2 is achieved. Depending upon the application, the nozzles 18 may be directed upwardly and or downwardly of the horizontal.

Once mixing is completed, the isolating valve 42 is closed and the pump 38 is removed from the pipe 28 to permit discharge of the contents of the container 2.

Figure 6:
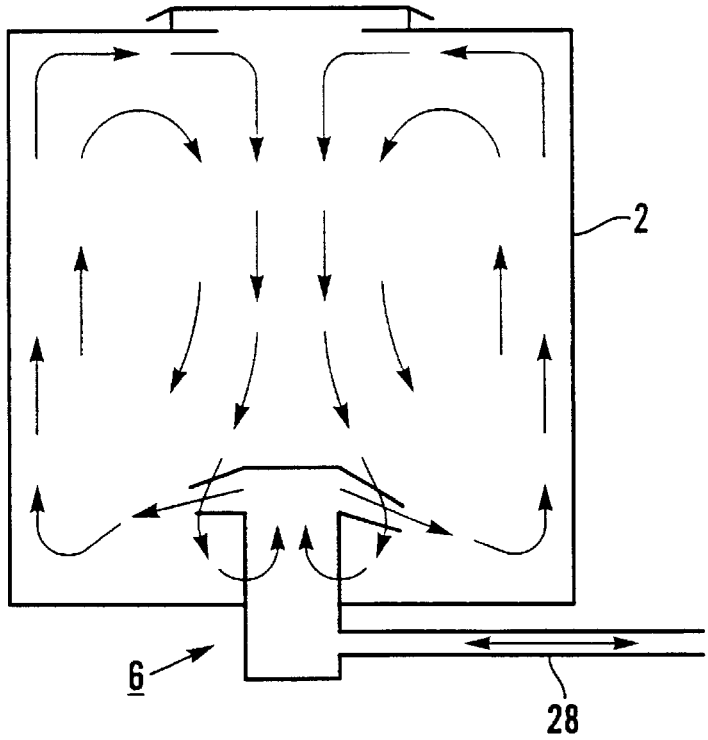

Alternatively, a T-junction may be provided in the pipe 28 to enable discharge without removal of the pump 38 as shown in FIG. 6.

FIGS. 1 and 2 illustrate an intrusive mixing system in which the mixing head of the apparatus 6 extends through a wall of the container 2.

Figure 3:
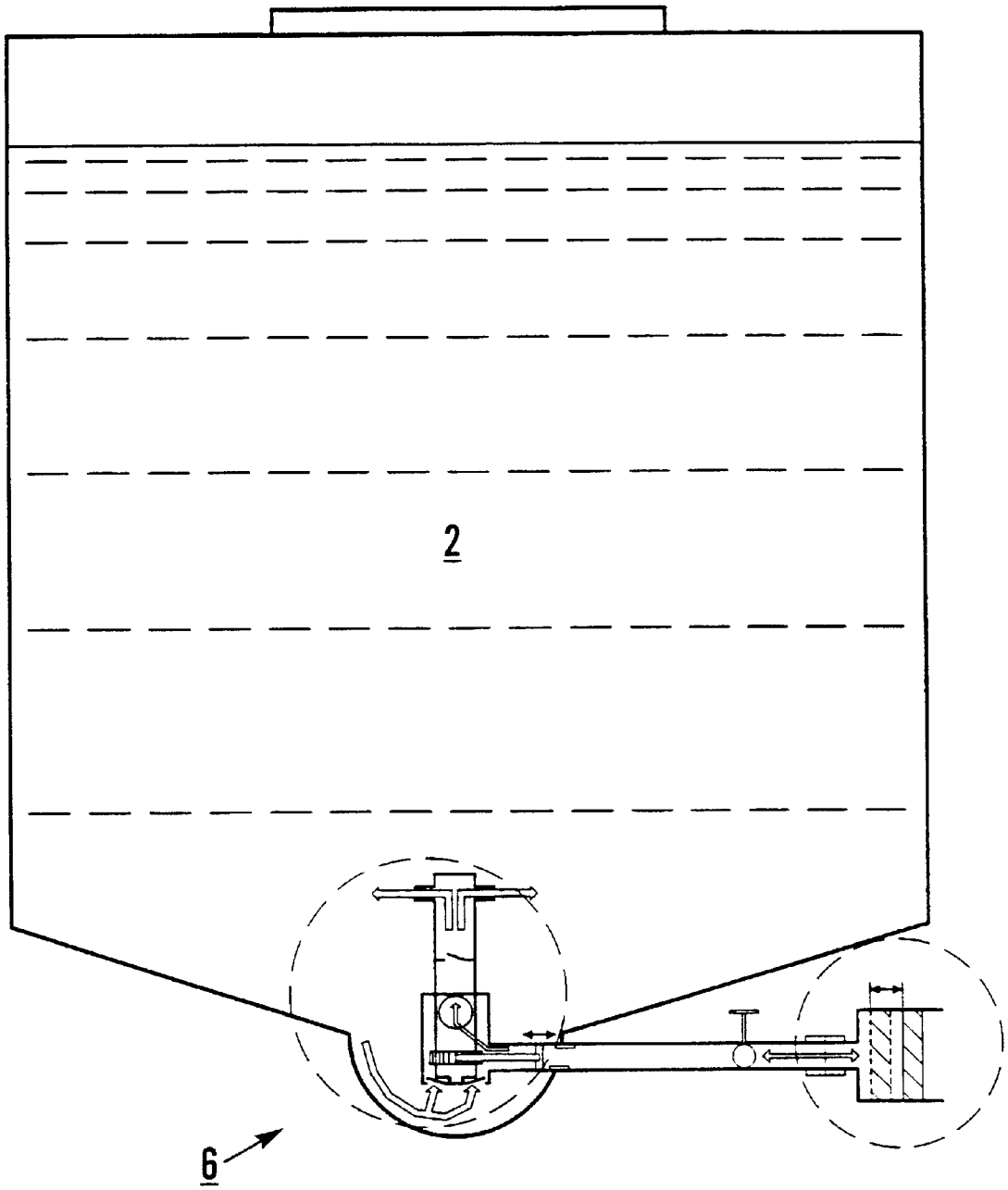
FIG. 3 is a diagrammatic vertical section through an alternative mixing apparatus according to the invention in a container.
Figure 4:
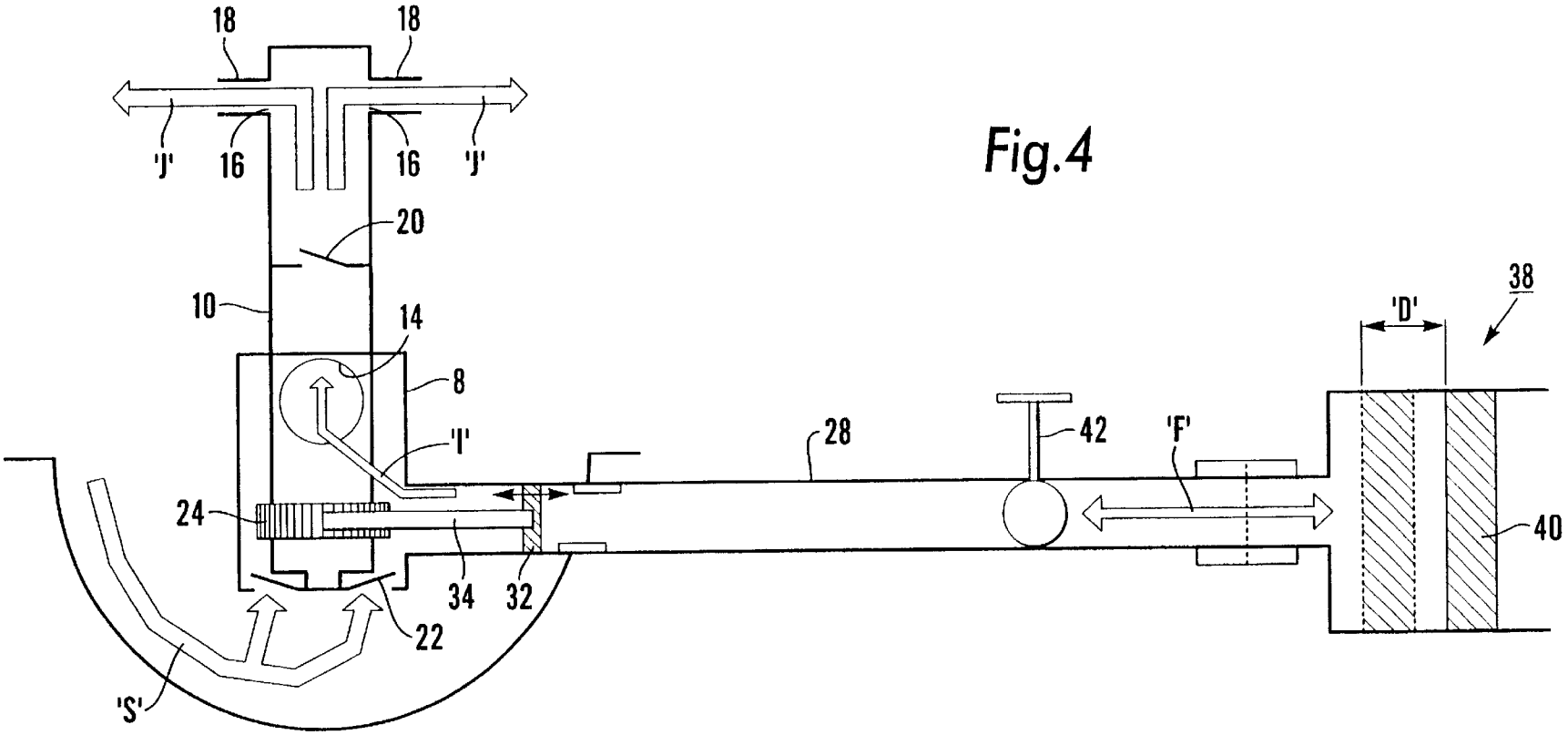
FIG. 4 shows the apparatus of FIG. 3 to a larger scale.

FIGS. 3 and 4 illustrate what can be termed a non-intrusive system in which the mixing head of the apparatus 6 is totally housed within the container 2.

Referring to FIGS. 3 and 4, there is shown an alternative mixing apparatus in which components equivalent to those of FIGS. 1 and 2 are similarly referenced.

The fundamental operation of the embodiment of FIGS. 3 and 4 is exactly the same as that of the embodiment of FIGS. 1 and 2, the only differences being in the position of the one way valve 22 and the flow path of liquid from the container into the discharge pipe 28.

The valve 22 or flow restrictor is located at the lower end of the housing 8 such that, on return movement of the piston assembly 40 of the pump 38—ie. to the right as viewed in FIG. 4—liquid flows through the valve 22 into the annular space between the housing 8 and the sleeve 10 as indicated by the arrow 'S' and into the discharge pipe 28 to move the mechanism 30 to the right.

Thus there is provided mixing apparatus which is capable of thoroughly mixing large volumes of liquid in an efficient and effective manner. Although primarily developed for mixing coating materials such as paint, the apparatus can be used to mix a variety of substances such as pharmaceuticals, speciality chemicals, foodstuffs, mixtures requiring gaseous blankets and any substance that requires isolation from the surrounding environment.

The mixing apparatus can be readily mounted on standard IBC's using simple tools, the system being such as to enable users to mix without compromising product integrity or resorting to specialised containers.

Alternatively, and as illustrated in FIGS. 3 and 4, the mixing apparatus can be mounted within the lower regions of a container and retained in position by co-operation with the internal wall of the discharge pipe as it exits the container.

In all cases, the pneumatic drive to the pump provides a reciprocating backwards and forwards motion within the liquid in the discharge pipe the energy from which is used to rotate the outlet nozzles such as to create extensive agitation of the liquid within the container and throughout the volume of said liquid.

The frequency of the pump, and the degree of rotation of the sleeve per pulse of liquid can be chosen to suit particular requirements depending upon the product and the application.

Clearly the precise construction of the apparatus can vary from that described and illustrated without departing from the scope of the invention. In particular the transducer mechanism to convert the flow energy of the liquid into rotation of the jets may be other than the pawlratchet mechanism detailed above, the reciprocating flow within the discharge pipe may be created other than by a double diaphragm pump, and there may be more than two jets per sleeve. Other modifications and variations will be apparent to those skilled in the art.

What is claimed is:

1. A mixing apparatus for a liquid container, the apparatus comprising a hollow sleeve member for location in the lower regions of the container, a plurality of circumferentially spaced outlets being provided in the upper regions of the sleeve member, and pump means for creating a reciprocating flow of liquid applied to the lower regions of the sleeve member, and in the flow path of liquid from the pump means to the sleeve member, a transducer mechanism co-operating with the sleeve member and subjected to the reciprocating flow of liquid such as to rotate the sleeve member about its central longitudinal axis in dependence upon said reciprocating flow.

2. A mixing apparatus as claimed in claim 1 in which the pump means comprise a double acting diaphragm pump, the reciprocating movement of the diaphragms creating a mass movement of liquid into and out of the container.

3. A mixing apparatus as claimed in claim 1 in which the transducer mechanism comprises a ratchet wheel secured to, to be rotatable with, the sleeve member, and one or more pawls adapted to engage the ratchet wheel and linearly movable by, in the direction of movement of, the reciprocating liquid.

4. A mixing apparatus as claimed in claim 3 in which there are two pawls mounted on a carrier and engaging diametrically opposite teeth of the ratchet wheel, the reciprocating movement of the liquid resulting in reciprocating movement of the carrier and attached pawls, each such movement of the carrier resulting in consequential stepped rotation of the sleeve member, each step being in the same direction of rotation.

5. A mixing apparatus as claimed in claim 1 in which there are two diametrically opposed outlets from the upper regions of the sleeve member, each outlet being directed substantially radially from the sleeve member.

6. A mixing apparatus as claimed claim 1 in which the sleeve member and associated transducer mechanism are located wholly within the lower regions of the associated container.

7. A mixing Apparatus as claimed in claim 1 in which the sleeve member extends through an aperture in the container to locate the outlets therefrom within the lower regions of the container, the lower regions of the sleeve member and the transducer mechanism being external of the container.

* * * * *